United States Patent [19]

Yamaguchi et al.

[11] 4,135,013

[45] Jan. 16, 1979

[54] METHOD FOR THE PREVENTION OF STRESS CORROSION CRACKING

[75] Inventors: Kineo Yamaguchi, Urawa; Katsuhiko Kawakami, Kurashiki, both of Japan

[73] Assignee: Nippon Mining Co., Ltd., Tokyo, Japan

[21] Appl. No.: 764,142

[22] Filed: Jan. 31, 1977

Related U.S. Application Data

[63] Continuation of Ser. No. 628,859, Nov. 5, 1975, abandoned.

[30] Foreign Application Priority Data

Nov. 5, 1974 [JP] Japan ..... 49-126569

[51] Int. Cl.[2] ..... C10G 23/00; C23C 7/00

[52] U.S. Cl. ..... 427/405; 427/427; 427/287; 427/225; 228/199; 29/460; 196/46; 208/208 R; 208/209; 428/653

[58] Field of Search ..... 29/460; 196/46, 46.1; 208/208 R, 208 M, 209, 210, 211, 212, 213, 214, 215, 216, 217, 218; 228/199; 427/405, 406, 427, 225, 287

[56] References Cited

U.S. PATENT DOCUMENTS

| | | | |
|---|---|---|---|
| 3,058,206 | 10/1962 | Mets | 427/405 X |
| 3,922,396 | 11/1975 | Speivs | 427/328 |

OTHER PUBLICATIONS

Evans, An Introduction to Metal Corrosion, Edward Arnold & Co., London, 1948, p. 123.

Kirk-Othmer, Encyclopedia of Chemical Technology, vol. 6, John Wiley & Son, pp. 298, 303.

*Primary Examiner*—Ralph S. Kendall

*Attorney, Agent, or Firm*—Sughrue, Rothwell, Mion, Zinn and Macpeak

[57] ABSTRACT

Equipment used in a substantially water free, but corrosive environment is protected from corrosion by coating only certain welded parts thereof with a metal more base than the metal part coated.

6 Claims, 1 Drawing Figure

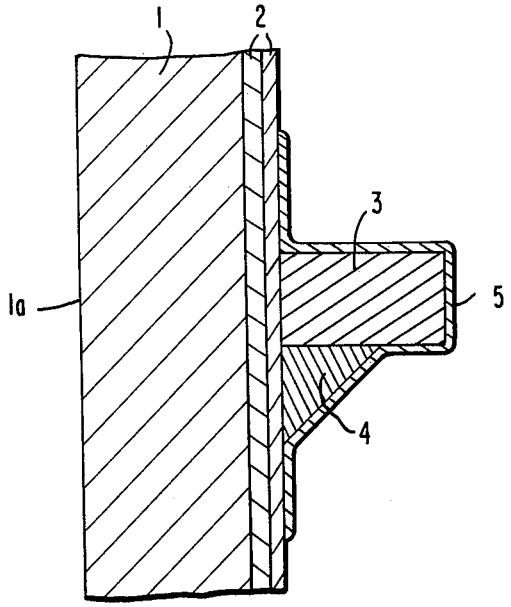
1
2
3
1a
5
4

METHOD FOR THE PREVENTION OF STRESS CORROSION CRACKING

This is a continuation, of application Ser. No. 628,859, filed Nov. 5, 1975, abandoned.

BACKGROUND OF THE INVENTION

This invention relates to a method for the prevention of stress corrosion cracking, and more particularly, to a method for the prevention of stress corrosion cracking of machinery in a corrosive environment having very little water.

Generally, methods for the prevention of stress corrosion cracking have been developed for use with machinery in an environment of aqueous solutions containing corrosive anions. Methods heretofore proposed include, for example, (1) coating aluminum or magnesium on a surface of austenic steel, and (2) using a two-phase alloy with a ferrite phase overlaid on austenite steel. However, these methods have been limited to use in corrosive environments having large amounts of water. On the other hand, research and investigation into stress corrosion cracking in corrosive environments having an extremely small amount of water and at high temperatures have scarcely been conducted since there has been only slight development of technology of this kind. One example of such a corrosive environment is found in petroleum refineries where heavy oil desulfurization units are used. Under the present conditions, there is no protective method for preventing minute cracks in the type of machinery mentioned.

SUMMARY OF THE INVENTION

This invention has been achieved as a result of repeated research and investigation directed toward solving the above-mentioned problem. According to the invention there is provided a method for the prevention of stress corrosion cracking of machinery comprising coating the metal part of the machinery which is in contact with corrosive materials with a metal more base than that of said machinery metal, or with an alloy essentially consisting of said base metal in a corrosive environment with extremely small amounts of water.

BRIEF DESCRIPTION OF DRAWINGS

The FIGURE is a longitudinal sectional end view of a tray support ring portion in a reactor of heavy oil desulfurization units in petroleum refineries showing a preferred embodiment according to the present invention.

DETAILED DESCRIPTION OF DRAWINGS

Generally, stress corrosion cracking occurs in an environment where water is present. The corrosion is the result of electrochemical activity which occurs when a corrosive anion is adsorbed on a stress conentrated portion. As a result a local cell or locallized battery is created and the corrosion proceeds from crevices in the passive surface to cause stress corrosion crackings. To improve such corrosion environments sacrifice anodes have been used or, overall metallizing of aluminum or magnesium or the like has been carried out.

However, the cause of stress corrosion cracking in a substantially water-free environment (e.g., a corrosion environment at high temperature and high pressure in raw oil and in a hydrogen atomosphere such as found in heavy oil desulfurization units in petroleum refineries) has not been investigated. Alkali washing has been employed as a measure to prevent such corrosion. However, it has been difficult to prevent minute cracks from occurring and spreading.

As a result of research and investigation on the cause of cracks in the machinery in a water-free environment, the present inventors discovered that cracks did not occur in castings, forgings and automatically welded parts but did occur in stress concentration portions which are manually welded, such as welded parts of fitting members by which the load of machinery is supported and gap portions between components of machinery. It has thus been discovered that the cause of such corrosion is a very small amount of water content adsorbed on the passive surface (e.g., thin oxide films naturally occurring) in the welded portions and gap portions such as slits or micro cracks when the operation of the machinery is started and stopped. The adsorbed water dissolves during the time it is in contact with raw oil, various ions, particularly, corrosive anions such as chlorine ion, sulfur ion, etc., and the anions are thus absorbed on the uneven passive surface in the above-mentioned stress concentrated portions and gap portions and accordingly the corrosion proceeds.

According to the present invention, therefore, manually welded portions, such as welded parts of fittings and gap portions between components of machinery, are coated with a layer of metal which is more base than the metal which constitutes said machinery. Examples of the coating metal are: aluminum, magnesium, zinc, or an alloy containing one or more thereof. As used herein, a coating metal is more base than the foundation metal if it is more electrochemically positive, i.e., in a local cell, the more base metal will give up positive ions to the electrolyte. Thus, when the water, containing corrosive anion, is absorbed on the coated layer of base metal, in a corrosive environment with extremely little water, the base metal becomes a sacrifice anode before the foundation metal is damaged to form a local cell. As a consequence, a corrosion resistant electric current flows into the foundation metal to prevent corrosion and resulting stress corrosion cracking in the stress concentration portions in the machinery and gap portions between components of machinery. For example, a metallizing process such as metal spraying is employed for the purpose of coating parts of the machine with the base metal, whereby the metal coated portions have a coarse satin-like finish, which not only disperses water but minimizes the local cell effect, and exhibits remarkable effects with the thickness of the coated layer of base metal of more than 0.01 mm.

Thus, according to the present invention, a corrosion resistant base metal need only be applied to the part of machinery which actually requires the sacrifice anode so that the stress corrosion cracking which might lead to a serious trouble may easily and economically be prevented.

The effectiveness of the present invention can be appreciated from the following description of an experiment using the present invention.

In a heavy oil desulfurizing reactor having several stages of tray support rings manually welded therein, the second and sixth support rings only were metallized on half of the periphery thereof with high purity aluminum according the present invention, whereas the remaining one half peripheral portions were left unmetallized for the purpose of comparison. A fragmentary longitudinal sectional end view of the reactor, showing a portion where the aforesaid metallizing has been applied, is shown in the drawing. The reference numeral 1 designates a metal portion of the machinery, 2 a metal portion coated by automatic welding, 3 a support ring, 4 a manually welded fillet metal, and 5 a base metal coating layer according to the present invention.

Metallizing with high purity aluminum was carried out by a wire-type gas metallizing machine using a high purity aluminum wire containing 99.9% of aluminum to coat the surfaces of support ring 3 and fillet metal 4. The coating extended over 200 mm below the lower edge of the fillet metal 4, so as to sufficiently cover those parts thermally affected by welding, and extends over 200 mm from the upper surface of support ring 3, so as to sufficiently cover a gap portion formed between the top coated metal 2 and the support ring 3. The layer of coated aluminum thus formed had a thickness of 0.5 to 0.8 mm. Prior to metallizing the surfaces, the surface portions were first subjected to the application of flame by the conventional procedure to remove fats therefrom. Thereafter, said portions were blast cleaned with a powder composed of a mixture of alumina powder of 24 mesh and alumina powder of 30 mesh in equal amounts. After metallization with the aluminum, the interior of the reactor was cleaned, a desulfurization catalyst was charged therein and the operation was started in accordance with the normal operating procedure. Then, the reactor was put in operation for a period of six months under the operating conditions at hydrogen gas pressure of 120 to 140 atomospheres and at temperatures of 350° to 400° C, after which the operation thereof was stopped. The spent catalyst was removed, and the occurrence of cracks and propagation thereof with respect to the aforesaid second and sixth support rings were tested by visible dye penetrant inspection. After such tests were made, a catalyst was charged again and the reactor put back into operation. Thereafter the tests were conducted every 6 months for 2 years. The test results show a striking contrast between the support ring portions embodying the present invention and portions not embodying the invention. As shown in the following Table, there was considerable occurrence of cracks and propagation of the past cracks in the parts not coated, whereas there were none in the coated parts.

| | Portion applied with the present invention | | Portion not applied with the invention | |
|---|---|---|---|---|
| Period of operation (month) | Occurrence of cracks (number) | Propagation of cracks | Occurrence of cracks (number) | Propagation of cracks |
| 6 | 0 | not propagated | 3 | |
| 12 | 0 | " | 15 | propagated |
| 18 | 0 | " | 9 | " |
| 24 | 0 | " | 6 | " |

What is claimed is:

1. A method for preventing stress corrosion cracking of apparatus made of a first ferrous metal having manually welded portions and gap parts therein used in a corrosive and substantially water free environment in a heavy oil desulfurization unit at a temperature of from 350° to 400° C and containing petroleum oil components and a hydrogen atmosphere at a pressure of 120 to 140 atm. which comprises:

(a) Coating the surface of the manually welded portion of said first ferrous metal and covering said gaps with a second metal which is more electrochmeically positive than said first metal, said second metal being a member selected from the group consisting of aluminum, magnesium, zinc and an alloy containing aluminum, magnesium or zinc, said coating covering said welded portion and gap parts and extending at least 200 mm beyond the periphery thereof, and (b) Placing the coated portion of said first ferrous metal in said corrosive environment.

2. The method of claim 1 wherein said coating is thicker than 0.01 mm.

3. The method of claim 1 wherein said coating has a thickness between 0.5 and 0.8 mm.

4. The method of claim 1 wherein said coating metal is high purity aluminum.

5. The method of claim 1, wherein said second metal is selected from the group consisting of aluminum, magnesium and zinc.

6. The method of claim 1, wherein said second metal is an alloy of the elements selected from the group consisting of aluminum, magnesium, and zinc.

* * * * *